US012329257B1

(12) United States Patent
Xiang

(10) Patent No.: US 12,329,257 B1
(45) Date of Patent: Jun. 17, 2025

(54) CARD HOLDER

(71) Applicant: Hong Kong Changze Technology Limited, Hong Kong (CN)

(72) Inventor: Lian Xiang, Chongqing (CN)

(73) Assignee: Hong Kong Changze Technology Limited, Hong Kong (CN)

( * ) Notice: Subject to any disclaimer, the term of this patent is extended or adjusted under 35 U.S.C. 154(b) by 0 days.

(21) Appl. No.: 18/931,895

(22) Filed: Oct. 30, 2024

(30) Foreign Application Priority Data

Jul. 24, 2024 (CN) ..... 202421768188.X

(51) Int. Cl.
*A45C 11/18* (2006.01)

(52) U.S. Cl.
CPC ..... *A45C 11/182* (2013.01)

(58) Field of Classification Search
CPC ..... A45C 11/182
USPC ..... 150/147
See application file for complete search history.

(56) References Cited

U.S. PATENT DOCUMENTS 8,899,411 B2 12/2014 Van Geer
9,980,546 B2 * 5/2018 Van Der Laan ..... A45C 13/02
10,201,216 B2 * 2/2019 Van Geer ..... A45C 11/182
10,653,222 B2 5/2020 Scharnigg et al.
11,234,502 B2 * 2/2022 Van Geer ..... B65D 83/08
11,344,091 B2 * 5/2022 Goodwin ..... A45C 11/182
11,969,066 B1 * 4/2024 Zeng ..... A45C 1/06
2015/0335118 A1 * 11/2015 Van Geer ..... A45C 11/182 150/147

FOREIGN PATENT DOCUMENTS

EP 3521053 B1 11/2021

* cited by examiner

*Primary Examiner* — Sue A Weaver
(74) *Attorney, Agent, or Firm* — Renner, Otto, Boisselle & Sklar, LLP

(57) ABSTRACT

A card holder is disclosed, which relates to the technical field of wallets, and includes a case, a card arm, and a cover member. The case includes a first cavity configured to accommodate a card stack including at least two cards. A first card exit is provided on an end wall of the case. The first card exit is in communication with the first cavity. The card arm is arranged in the first cavity, and is configured to push the card stack out of the first card exit, such that at least some of the cards in the card stack are stacked in a dispersed state outside the first cavity. The cover member is arranged on an outer side of a side wall of the case. The cover member is configured in such a manner that a second cavity configured to receive at least one card.

16 Claims, 18 Drawing Sheets

CARD HOLDER

CROSS-REFERENCE TO RELATED APPLICATION

This application is based on and claims the benefit of priority from Chinese Patent Application No. 202421768188X, filed on 24 Jul. 2024, the entirety of which is incorporated by reference herein.

TECHNICAL FIELD

The present disclosure relates to the technical field of wallets, and in particular, to a card holder.

BACKGROUND

Traditional wallets are provided with pockets specially used for accommodating credit cards, identity cards, driver's licenses, access control cards, traffic cards, membership cards, etc. However, each pocket can only accommodate one card. In order to accommodate more cards, the number of pockets has to be increased, resulting in a large size of the wallet, and making it inconvenient for the user to carry. Moreover, the wallets are generally made of leather. In order to prevent the card from falling out of the pocket, the card and the pocket are generally designed to fit tightly. However, such a design makes it more difficult to take out the card. Therefore, there are card holders specifically used for accommodating cards in the existing technology. Such card holders generally can only store 5 to 6 cards, failing to meet the user's needs. In order to increase the number of cards to be accommodated, the size of the card holder needs to be increased, making it difficult for the user to carry the card holder.

SUMMARY

The present disclosure aims to at least solve one of the technical problems in the existing technology. To this end, the present disclosure provides a card holder, which can increase the number of cards accommodated in the card holder without significantly increasing the size of the card holder.

In accordance with a first aspect of the present disclosure, an embodiment provides a card holder, including: a case, including a first cavity configured to accommodate a card stack including at least two cards, where a first card exit is provided on an end wall of the case, and the first card exit is in communication with the first cavity; a card arm, arranged in the first cavity, and configured to push the card stack out of the first card exit, such that at least some of the cards in the card stack are stacked in a dispersed state outside the first cavity; and a cover member, arranged on an outer side of a side wall of the case, and configured in such a manner that a second cavity configured to receive at least one card and having a variable volume is defined by the cover member and the side wall, where the second cavity is provided with a second card exit.

The card holder according to the embodiment of the present disclosure at least has the following advantages.

With the configuration of the structure integrating the case and the card arm, the first cavity of the case is used for accommodating the cards, and the card arm can push the card stack out of the first card exit, such that the cards are stacked in a dispersed state, making it convenient for the user to take out the cards. With the additional configuration of the cover member on the outer side of the case, the cover member is configured to form the second cavity for accommodating cards with the side wall of the case, to allow the user to increase the number of cards that can be received in the card holder by means of the cover member as required. The volume of the second cavity can vary with the number of cards received. Therefore, the second cavity can accommodate more cards while the cover member does not significantly increase the size of the card holder, and the cards in the second cavity are pushed out through the second card exit of the second cavity. With the configuration of the first cavity and the second cavity for accommodating the cards in the card holder of this embodiment, the number of cards that can be received in the card holder can be increased without significantly increasing the size of the card holder.

In accordance with a second aspect of the present disclosure, an embodiment provides a card holder, including: a case, including a first cavity configured to accommodate a card stack including at least two cards, where a first card exit is provided on a side wall of the case, and the first card exit is in communication with the first cavity; and a card arm, arranged in the first cavity, and configured to push the card stack out of the first card exit, such that at least some of the cards in the card stack are stacked in a dispersed state outside the first cavity; where the case includes a volume expansion feature arranged on an outer side of the case, the volume expansion feature includes a second cavity configured to accommodate at least one card, the second cavity is provided with a second card exit, and the second cavity is configured in such a manner that a volume of the second cavity varies with a number of the at least one card.

The card holder according to the embodiment of the present disclosure at least has the following advantages.

With the configuration of the structure integrating the case and the card arm, the first cavity of the case is used for accommodating the cards, and the card arm can push the card stack out of the first card exit, such that the cards are stacked in a dispersed state, making it convenient for the user to take out the cards. With the additional configuration of the volume expansion feature on the outer side of the case, the volume expansion feature includes the second cavity and the second card exit through which the cards can be pushed out of the second cavity. The second cavity is used for accommodating the cards and its volume can vary with the number of cards received therein. Therefore, the volume expansion feature can accommodate more cards on the basis of the first cavity of the case without significantly increasing the size of the card holder. With the configuration of the first cavity and the second cavity for accommodating the cards in the card holder of this embodiment, the number of cards that can be received in the card holder can be increased without significantly increasing the size of the card holder.

Other aspects and advantages of the present disclosure will be given in the following description, some of which will become apparent from the following description or may be learned from practices of the present disclosure.

BRIEF DESCRIPTION OF DRAWINGS

The present disclosure is further described below in conjunction with the accompanying drawings and embodiments. In the drawings.

Figure 1:
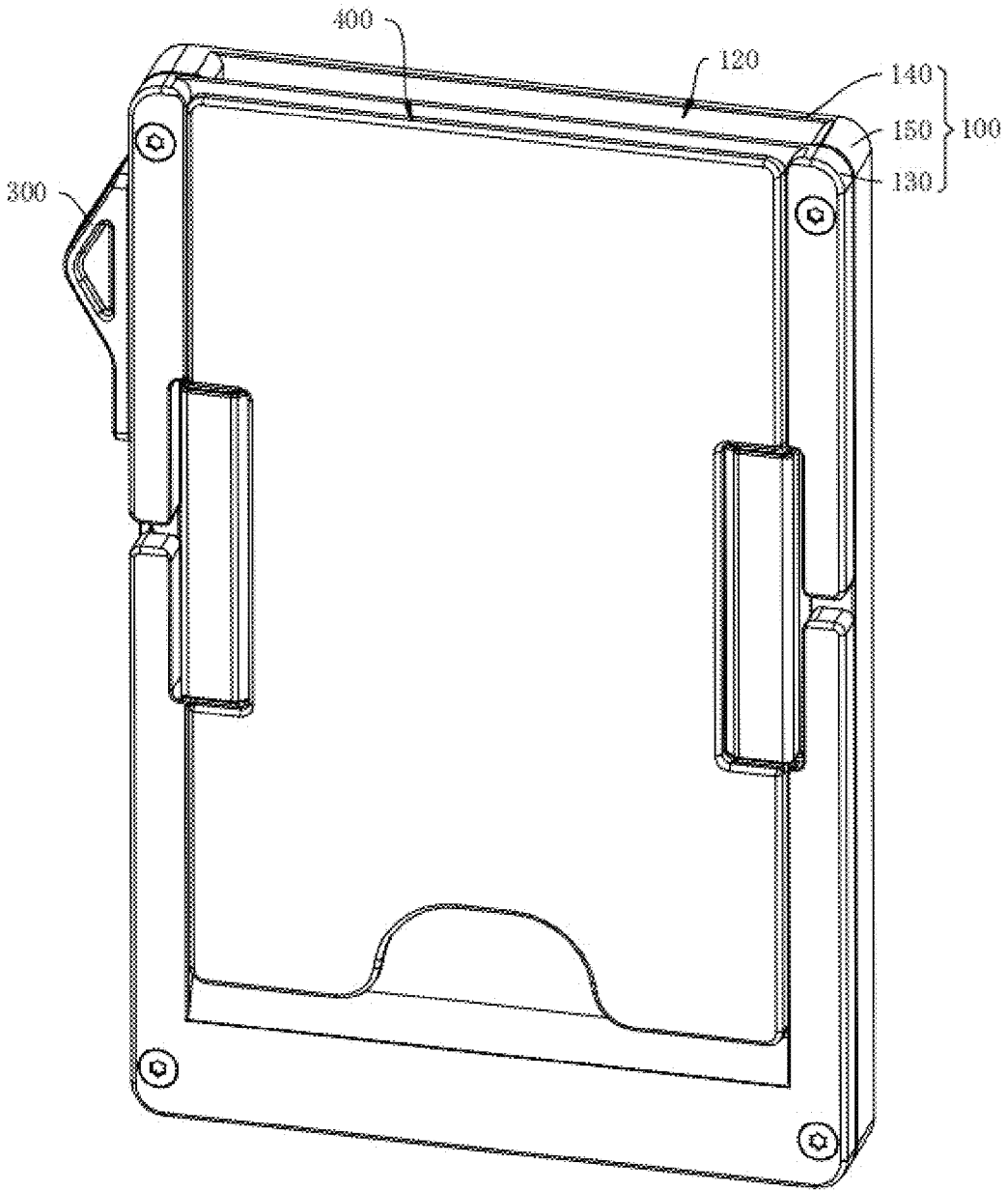
FIG. 1 is a schematic structural diagram of a card holder according to an embodiment of the present disclosure.

LIST OF REFERENCE NUMERALS case 100; first cavity 110; first card exit 120; first side wall 130; groove 131; open end 1311; closed end 1312; inclined surface 1313; first guide surface 1314; through hole 132; second communication groove 133; mounting groove 134; second breakage feature 135; second side wall 140; frame 150; sealing plate 160;

card arm 200;

actuating device 300;

cover member 400; second cavity 410; second card exit 420; cover plate 430; notch 431; second guide surface 432; positioning piece 433; first breakage feature 4331; perforation 434; first communication groove 435; pocket 440;

elastic band 500; first band body 510; second band body 520;

volume expansion feature 600;

card 700.

DETAILED DESCRIPTION

Embodiments of the present disclosure will be described in detail below with reference to the accompanying drawings in which the same or like reference characters refer to the same or like elements or elements having the same or like functions throughout. The embodiments described below with reference to the accompanying drawings are exemplary and are intended for illustration only and are not to be construed as limiting the present disclosure.

In the description of the present disclosure, it should be understood that for the description of orientations, the orientation or positional relationships indicated by the terms such as "on" and "below" are based on orientation or position relationships shown in the accompanying drawings, and are used only for ease and brevity of illustration and description, rather than indicating or implying that the mentioned apparatus or element must have a particular orientation or must be constructed and operated in a particular orientation. Therefore, such terms should not be construed as limiting of the present disclosure.

In the description of the present disclosure, "multiple" and "a plurality of" mean two or more. If used herein, the terms such as "first", "second" and the like are merely used for distinguishing technical features, and are not intended to indicate or imply relative importance, or implicitly point out the number of the indicated technical features, or implicitly point out the order of the indicated technical features.

In the description of the present disclosure, unless otherwise explicitly defined, the terms such as "configure", "install/mount" and "connect" should be understood in a broad sense, and those having ordinary skills in the art can reasonably determine the specific meanings of the above terms in the present disclosure based on the specific contents of the technical scheme.

Figure 2:
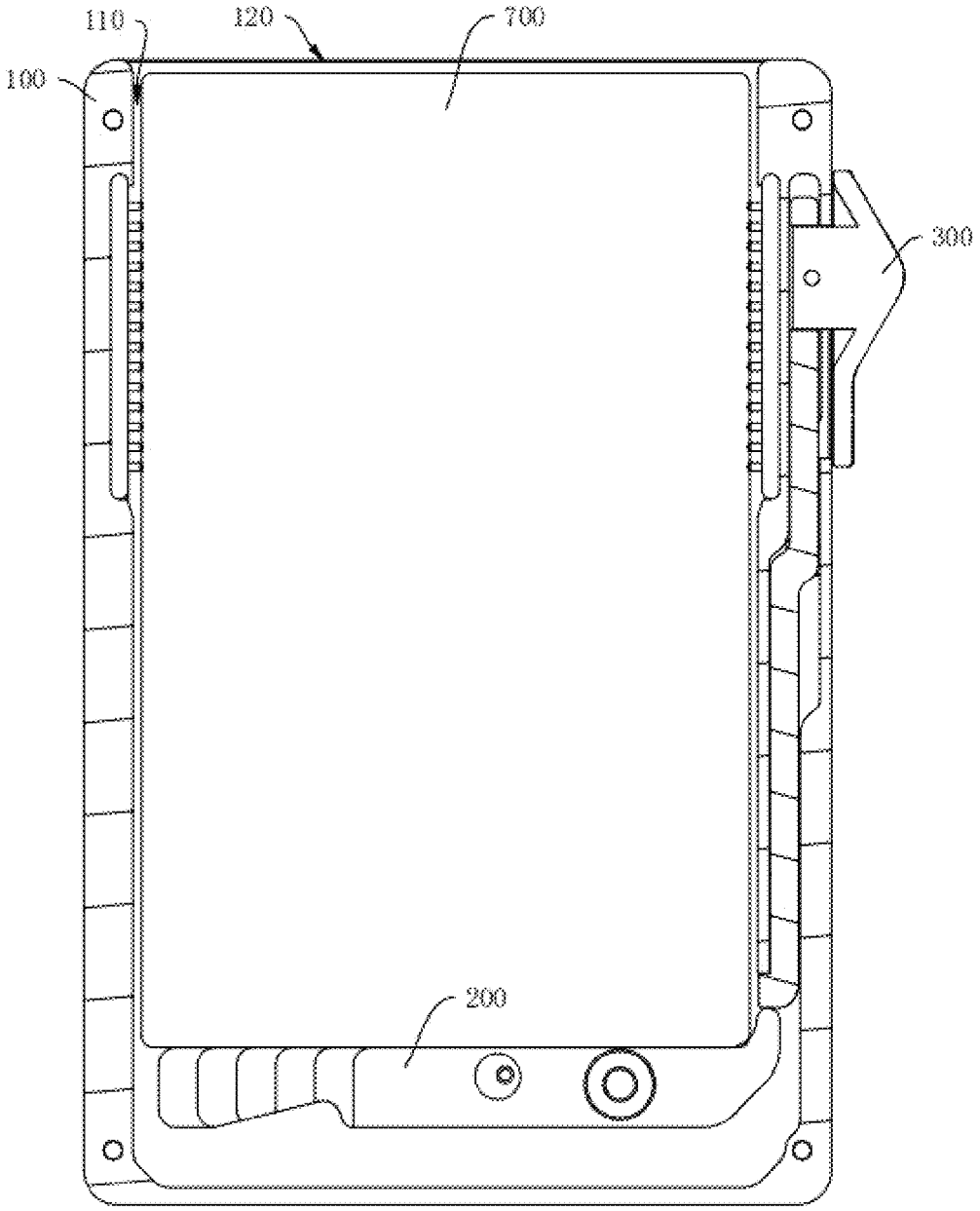
FIG. 2 is a schematic cross-sectional view showing cards in a stored state in a first cavity of the card holder shown in FIG. 1.

Referring to FIG. 1 and FIG. 2, a card holder according to an embodiment of the present disclosure is used for accommodating credit cards, identity cards, driver's licenses, access control cards, traffic cards, membership cards, etc. FIG. 1 is a schematic view of a card holder according to an embodiment, and FIG. 2 is a cross-sectional view of a card 700 received in the card holder according to this embodiment. The card holder of this embodiment includes a case 100 and a card arm 200. The case 100 includes a first cavity 110, and a first card exit 120 in communication with the first cavity 110 is provided on an end wall of the case 100. The first cavity 110 is configured to accommodate a card stack including at least two cards 700, and a user may place the card stack into the first cavity 110 of the case 100 through the first card exit 120. The case 100 may be made of a metal material to provide high structural strength, so as to protect the card stack in the case 100 and prevent the cards 700 from being bent or broken. Alternatively, the case 100 may be made of a hard non-metallic material.

Referring to FIG. 1, in an embodiment of the present disclosure, the case 100 has a substantially cuboid structure. The case 100 includes a first side wall 130, a second side wall 140, and a frame 150. The first side wall 130 is opposite to the second side wall 140. The first side wall 130 and the second side wall 140 are two side walls of the case 100 parallel to a card surface of the card 700 (i.e., a front surface which has the largest surface area). The frame 150 is connected between the first side wall 130 and the second side wall 140, and the first card exit 120 is provided at an end of the frame 150.

Figure 3:
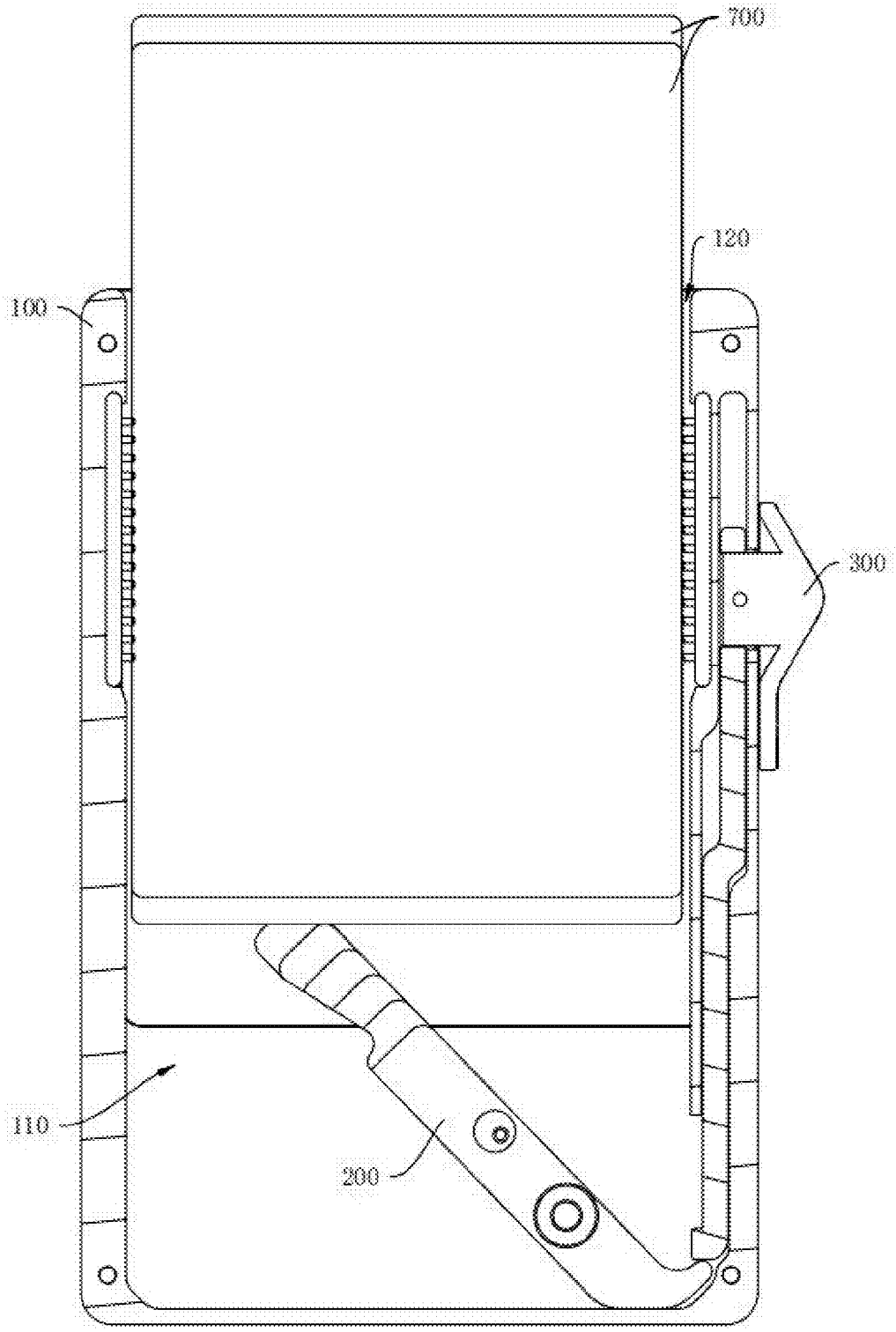
FIG. 3 is a schematic cross-sectional view showing cards in a pushed-out state in the first cavity of the card holder shown in FIG. 1 from a viewing angle.
Figure 4:
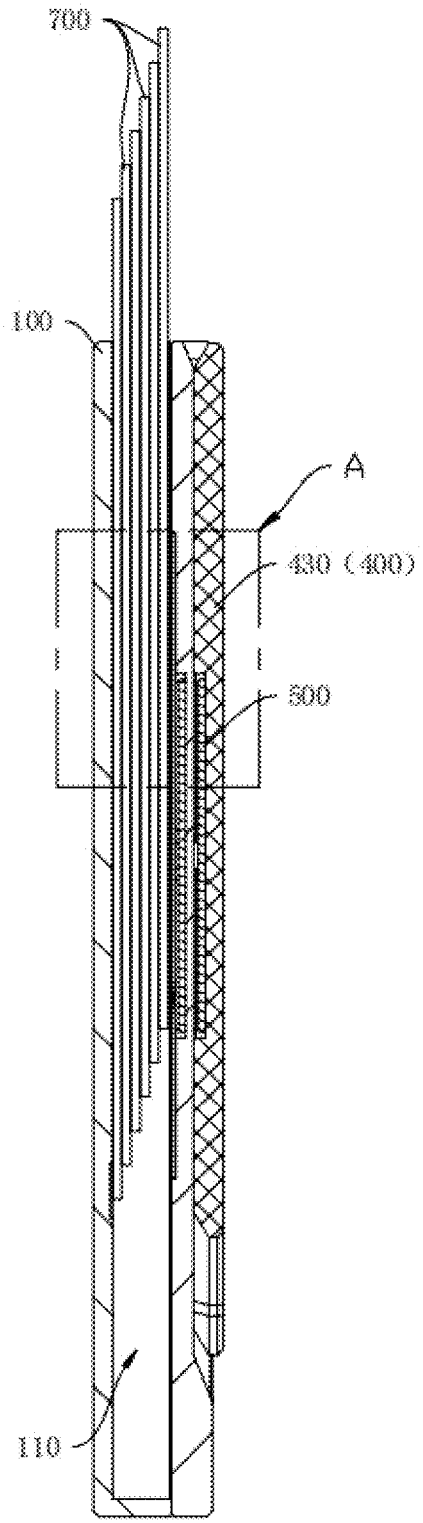
FIG. 4 is a schematic cross-sectional view showing cards in the pushed-out state in the first cavity of the card holder shown in FIG. 1 from another viewing angle, where the card arm is not shown.
Figure 14:
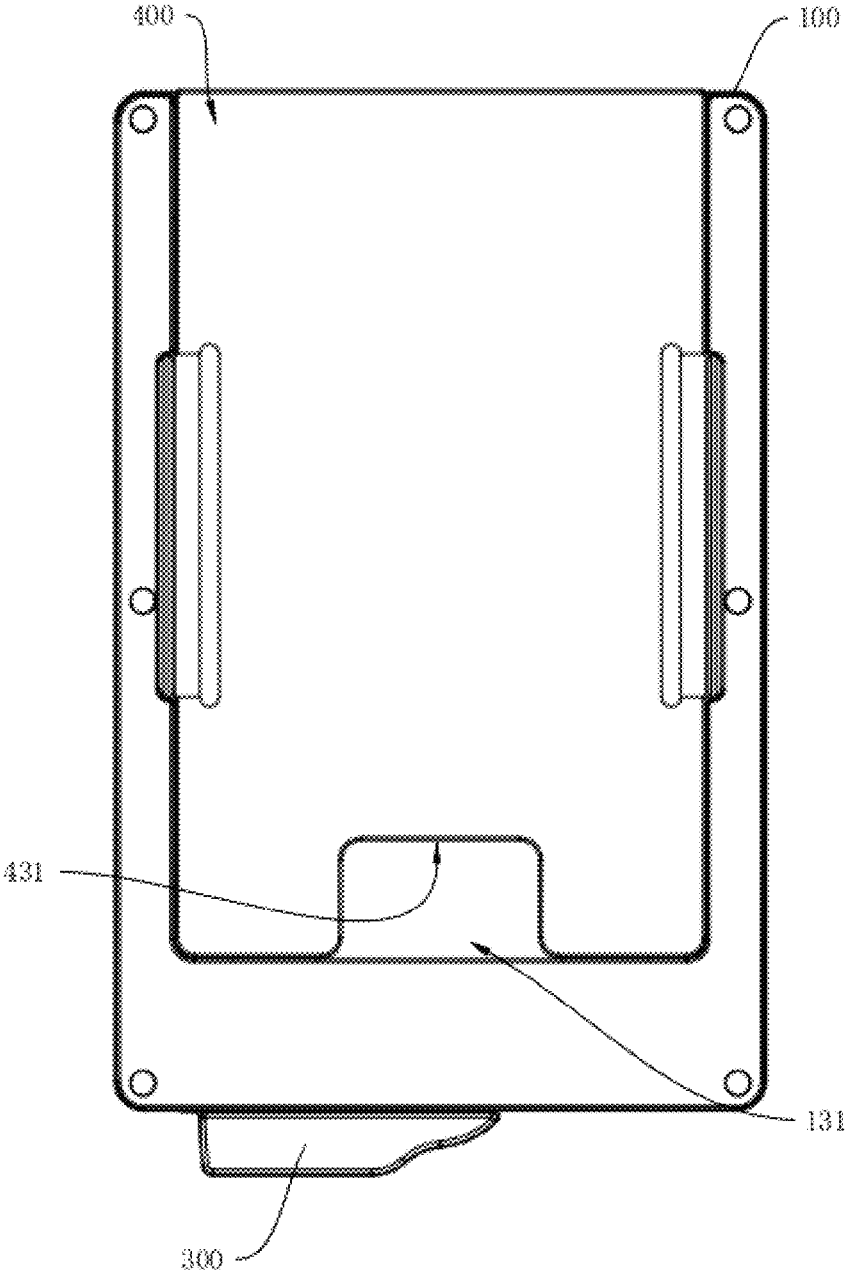
FIG. 14 is a schematic structural diagram of a card holder according to another embodiment of the present disclosure.

Referring to FIG. 3 and FIG. 4, FIG. 3 is a cross-sectional view of two cards 700 being pushed out of the card holder, and FIG. 4 is a cross-sectional view of six cards 700 being pushed out of the card holder in a dispersed manner. The card arm 200 is arranged in the first cavity 110. The card arm 200 is configured to push the card stack out of the first card exit 120. The card arm 200 may be driven by an actuating device 300 arranged on an outer side of the case 100, such as a slider, a button, a knob, or the like. The user may operate the actuating device 300 to drive the card arm 200 to rotate, so as to push the cards to move. It can be understood that the actuating device 300 may be arranged on a side edge of the frame 150 (as shown in FIG. 1), on a bottom edge of the frame 150 (as shown in FIG. 14), or on the second side wall 140, which is not limited herein. The card arm 200 is provided with a step feature or an inclined surface feature, such that when the card arm 200 pushes the card stack out of the first card exit 120, some or all of the cards 700 in the card stack are in a dispersed state (i.e., every two adjacent cards 700 do not overlap) and are stacked outside the first cavity 110. It should be noted that the card arm 200 pushes out the card stack by only a part of the length of the cards 700 to make it convenient for the user to access, instead of pushing the entirety of the cards 700 out of the first cavity 110.

Figure 5:
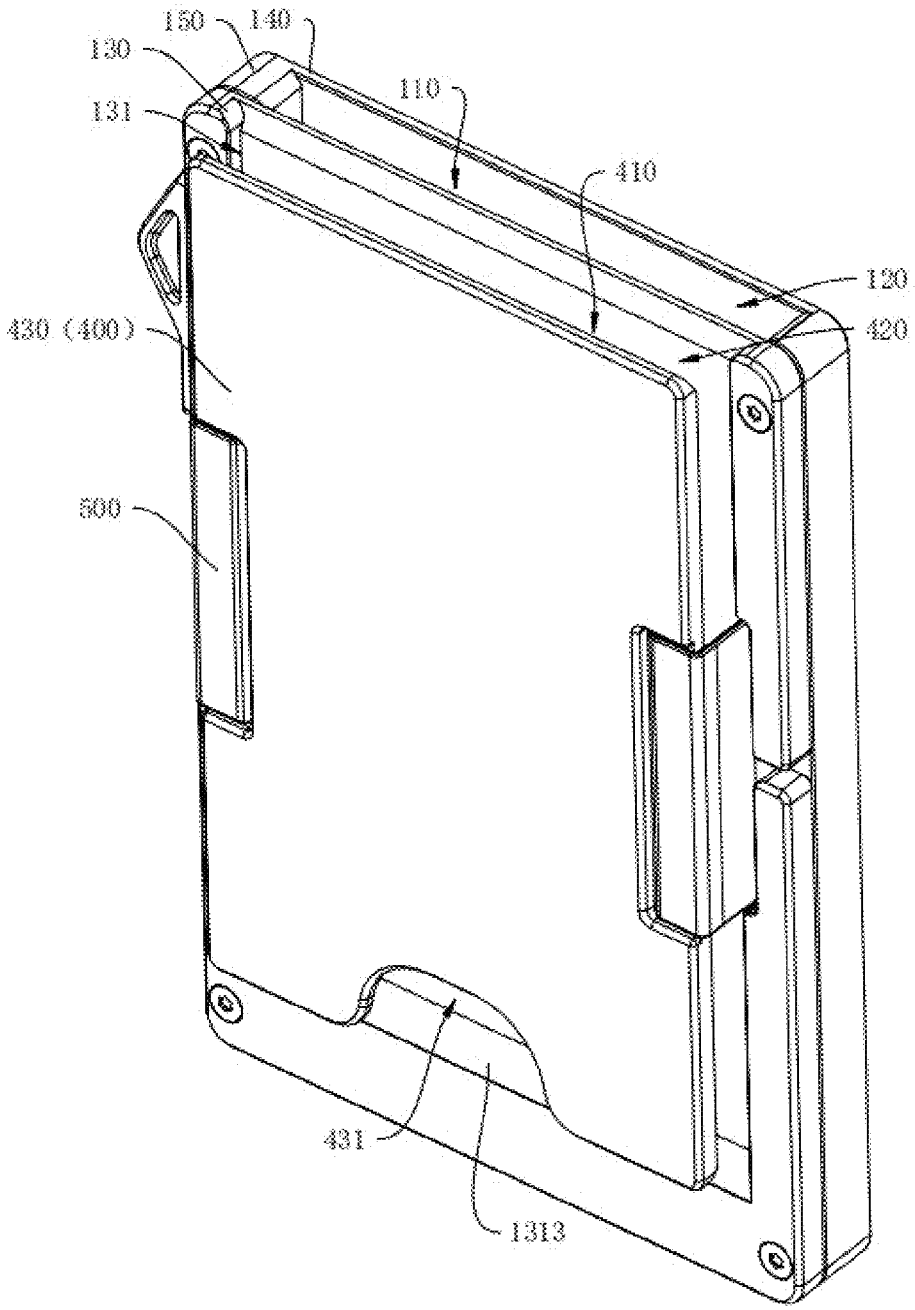
FIG. 5 is a schematic structural diagram of a card holder when there is a card in a second cavity according to an embodiment of the present disclosure.

Referring to FIG. 5, FIG. 5 is a schematic diagram showing a cover member 400 of the card holder of this embodiment in a state in which the cards 700 are accommodated. The card holder of this embodiment further includes a cover member 400 to increase the number of cards 700 that can be received in the card holder without significantly increasing the size of the card holder. The cover member 400 is arranged on an outer side of the first side wall 130 of the case 100. The cover member 400 is configured in such a manner that a second cavity 410 configured to receive at least one card 700 and having a variable volume is defined by the cover member 400 and the first side wall 130. The second cavity 410 is provided with a second card exit 420. The configuration of the second cavity 410 for accommodating the cards 700 allows the user to increase the number of cards 700 that can be received in the card holder by means of the cover member 400 as required. The volume of the second cavity 410 can vary with the number of cards 700 received. Therefore, the second cavity 410 can accommodate more cards 700 while the cover member 400 does not significantly increase the size of the card holder, and the cards 700 in the second cavity 410 are pushed out through the second card exit 420. The second card exit 420 may be located at an end of the second cavity 410 adjacent to the first card exit 120, or at an end of the second cavity 410 away from the first card exit 120. Alternatively, the card holder may be configured in such a manner that the user selectively takes out the card from any of two ends of the second cavity 410, i.e., the second card exit 420 is provided at each of the two ends of the second cavity 410.

With the configuration of the first cavity 110 and the second cavity 410 for accommodating the cards 700 in the card holder of this embodiment, the number of cards 700 that can be received in the card holder can be increased without significantly increasing the size of the card holder. Therefore, the card holder is easy to carry and is also convenient for the user to take out the cards 700.

Referring to FIG. 5, in an embodiment of the present disclosure, the cover member 400 is a cover plate 430, and the cover plate 430 is connected to the first side wall 130 by an elastic band 500. It can be understood that the elastic band 500 can be stretched by an external force and retracts to its original length when the external force is released. The elastic band 500 is configured to apply an elastic force toward the first side wall 130 to the cover plate 430, to drive the cover plate 430 to reset toward the first side wall 130. The second cavity 410 having a variable volume is defined between the cover plate 430 and the first side wall 130. When the user inserts the cards 700 into the second cavity 410, the second cavity 410 is expanded under the action of the cards 700, the cover plate 430 is pushed away from the first side wall 130, and finally the cover plate 430 covers and tightly fits to the cards 700 to clamp the cards 700. The user may place one or more cards 700 into the second cavity 410 at a time. When needing to take out a card 700, the user may push the card 700 to slide toward the second card exit 420 to protrude from the cover plate 430, and then take out the card 700. After the card 700 is taken out, the cover plate 430 continues to clamp and fix the other cards 700 in the second cavity 410 under the action of the elastic band 500, to prevent the other cards 700 from falling out of the second cavity 410. The combination of the cover plate 430 and the elastic band 500 in this embodiment can effectively reduce the overall size of the card holder, so that the user can easily carry the card holder.

The elastic band 500 in this embodiment may be made of, for example, polyester fiber, latex, rubber, silicone, or other synthetic materials. The cover plate 430 may be made of a metal material, which has a high structural strength and improves the durability of the card holder. Alternatively, the cover plate 430 may be made of a hard non-metallic material.

Figure 6:
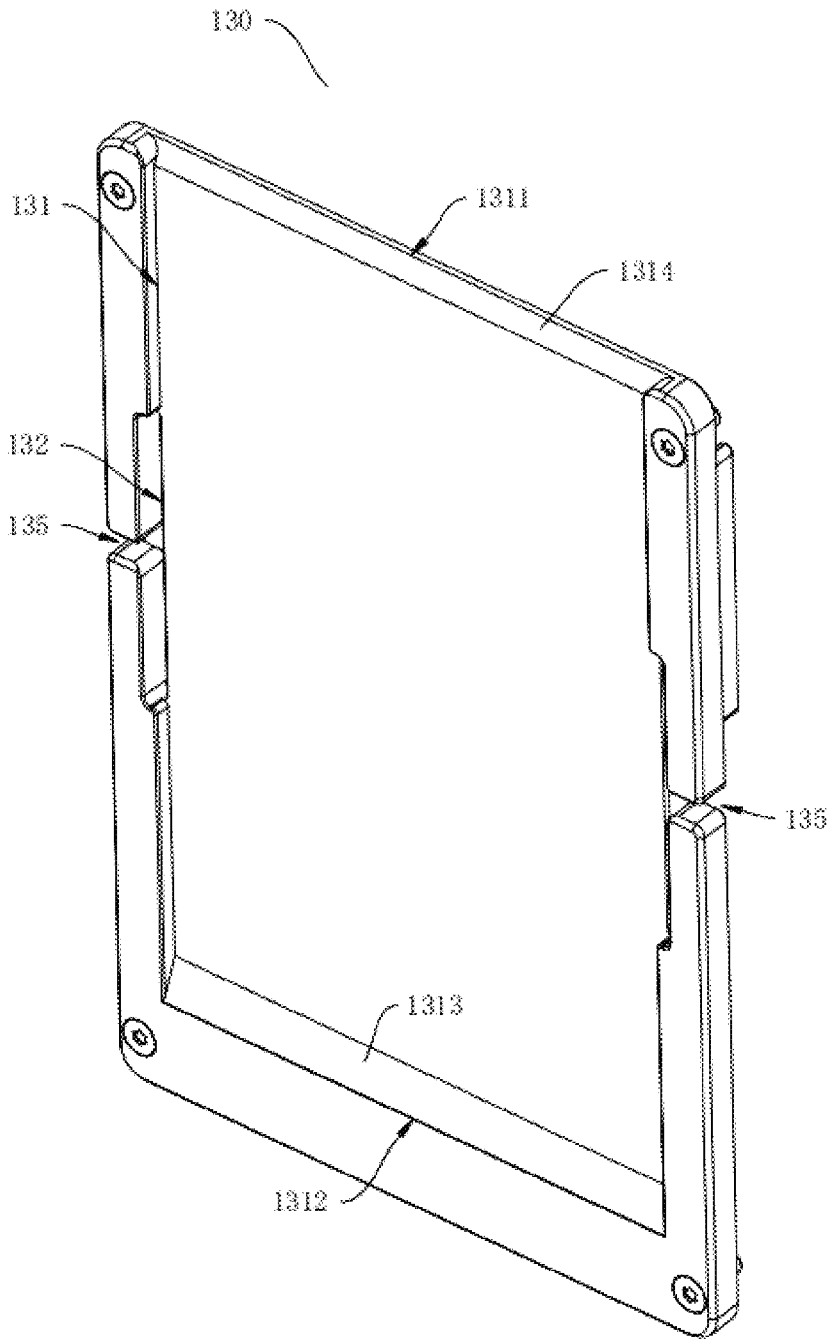
FIG. 6 is a schematic structural diagram of a first side wall in a card holder according to an embodiment of the present disclosure from a viewing angle.

Referring to FIG. 5 and FIG. 6, FIG. 6 is a schematic structural diagram of the first side wall 130 in the card holder shown in FIG. 5. In an embodiment of the present disclosure, a groove 131 which is inwardly recessed is provided on the outer side of the first side wall 130, and the groove 131 is formed in a partial area of the outer side of the first side wall 130. When there is no card 700 in the second cavity 410, the cover plate 430 can be received in the groove 131, and the groove 131 provides a function of positioning the cover plate 430, thereby improving the overall stability of the card holder. When there are cards 700 in the second cavity 410, the cards 700 can be more stably retained in the second cavity 410 due to the positioning function of the groove 131, thereby reducing the probability of the cards 700 falling out of the second cavity 410.

Still referring to FIG. 5 and FIG. 6, in an embodiment of the present disclosure, an end of the groove 131 adjacent to the first card exit 120 is an open end 1311, the second card exit 420 of the second cavity 410 is defined between the open end 1311 of the groove 131 and the cover plate 430, and an end of the groove 131 away from the first card exit 120 is closed. In the card holder of this embodiment, the second card exit 420 is at an end of the second cavity 410 adjacent to the first card exit 120, such that the card exiting direction of the first cavity 110 is the same as that of the second cavity 410, making it convenient for the user to insert a card 700 into the card holder or take a card 700 from the card exits of the card holder. An end of the second cavity 410 away from the first card exit 120 is a closed end 1312, and the cards 700 are constrained by the closed end 1312, thereby improving the stability of the cards 700 in the second cavity 410.

In this embodiment, referring to FIG. 5 and FIG. 14, FIG. 5 and FIG. 14 are respectively schematic structural diagrams of card holders according to two embodiments. The cover plate 430 is mounted in the groove 131. A notch 431 is provided at an end of the cover plate away from the second card exit 420 of the second cavity 410. The notch 431 is configured to expose the cards 700 in the second cavity 410. When needing to push the cards 700 out of the second card exit 420, the user may easily touch the cards 700 with a finger through the notch 431, and push the cards 700 out of the second card exit 420. As such, the cards can be more conveniently taken out from the second cavity 410.

Referring to FIG. 5 and FIG. 6, in an embodiment of the present disclosure, an end of the groove 131 adjacent to the first card exit 120 is an open end 1311, the second card exit 420 of the second cavity 410 is defined between the open end 1311 of the groove 131 and the cover plate 430, and an end of the groove 131 away from the first card exit 120 is closed. An inclined surface 1313 is provided at the closed end 1312 of the groove 131. The inclined surface 1313 is configured to guide the user's finger to move from the first side wall 130 toward a bottom wall of the groove 131, i.e., move from the first side wall 130 adjacent to the closed end 1312 toward the second card exit 420. Therefore, the user can easily push the cards 700 in the second cavity 410 out of the second card exit 420. It can be understood that when there are cards 700 in the second cavity 410, a gap exists between the cover plate 430 and the bottom wall of the groove 131. The gap will gradually increase as the number of cards 700 increases. The user can easily push the cards 700 out of the second card exit 420 by sliding a finger along the inclined surface 1313 toward the bottom wall of the groove 131 to push the cards 700 to move toward the gap.

Figure 7:
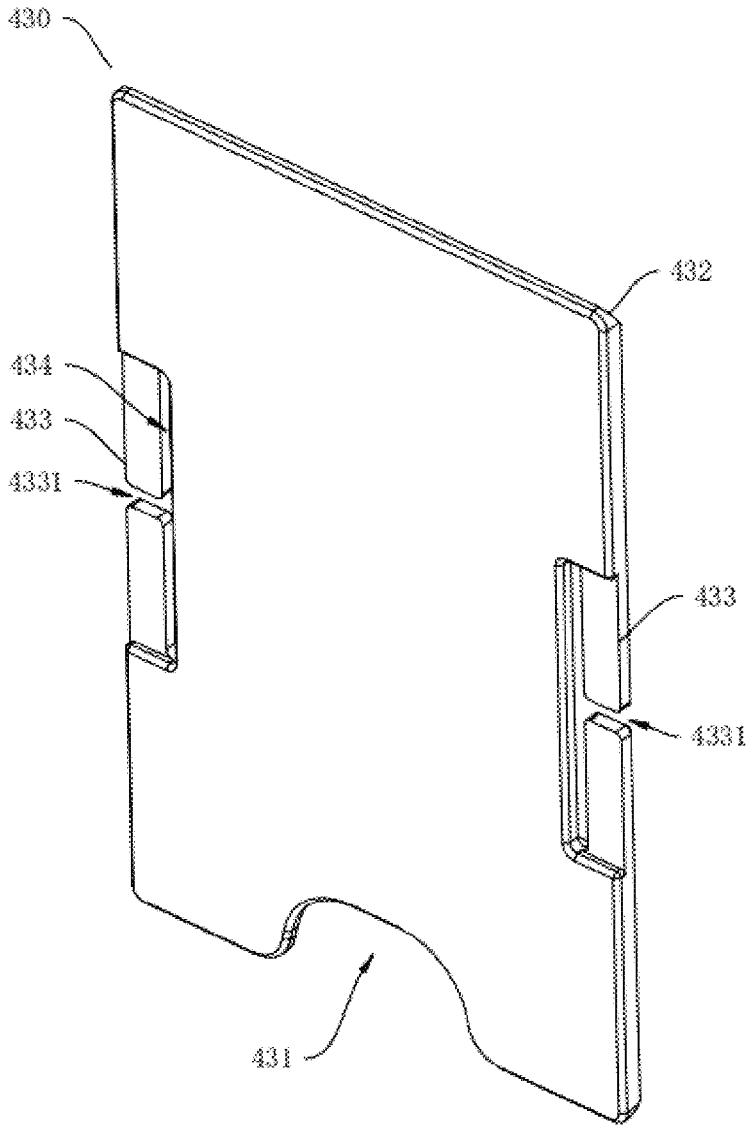
FIG. 7 is a schematic structural diagram of a cover plate in a card holder according to an embodiment of the present disclosure from a viewing angle.

Referring to FIG. 5 and FIG. 7, FIG. 7 is a schematic structural diagram of the cover plate 430 in the card holder shown in FIG. 5. The notch 431 is provided at an end of the cover plate 430 adjacent to the inclined surface 1313, making it convenient for the user to touch and push out the cards 700 with a finger. The notch 431 is configured to expose a part of the cards 700 in the second cavity 410 away from the second card exit 420. The notch 431 is adjacent to the inclined surface 1313. When the user slides a finger along the inclined surface 1313 toward the notch 431, the finger can easily touch the cards 700 through the notch 431, and push the cards 700 out of the second card exit 420. As such, the cards can be more conveniently taken out from the second cavity 410.

Alternatively, one side of the inclined surface 1313 connected to the bottom wall of the groove 131 is spaced apart from the cover plate 430. In this case, one end of each of the cards 700 facing the closed end 1312 of the groove 131 protrudes from the cover plate 430, and the cards 700 can be exposed at a gap between the cover plate 430 and the inclined surface 1313. As such, the user can more easily touch the cards 700 and push the cards 700 out of the second card exit 420 with a finger.

In an embodiment of the present disclosure, when there is no card 700 in the second cavity 410, an outer side of the cover plate 430 is flush with the outer side of the first side wall 130. Therefore, when there is no need to place cards 700 in the second cavity 410, the outer surface of the card holder on which side the cover plate 430 is provided is a flat surface, and the card holder is not easily stuck when placed in a pocket of clothes or trousers, providing a better user experience.

Referring to FIG. 5, FIG. 6, FIG. 7, and FIG. 12, a first guide surface 1314 is provided at an end of the bottom wall of the groove 131 adjacent to the second card exit 420, and a second guide surface 432 is provided at an end of an inner side of the cover plate 430 adjacent to the second card exit 420. The second guide surface 432 and the first guide surface 1314 are configured to be inclined toward the second cavity 410 in a direction in which the cards 700 enter the second cavity 410, such that at the second card exit 420, the first guide surface 1314 and the second guide surface 432 form a structure having an opening which gradually widens toward an outer side of the second card exit 420. Therefore, when the cards 700 are inserted into the second cavity 410 through the second card exit 420, the cards 700 can smoothly slide into the second cavity 410 by means of the first guide surface 1314 or the second guide surface 432. As such, the cards 700 can be inserted more smoothly. In addition, the cards 700 can also be pushed out from the second card exit 420 in a smoother and dispersed manner, making it convenient for the user to select and take out an appropriate card 700.

Alternatively, in another embodiment of the present disclosure, the first side wall 130 is a flat surface, i.e., the groove 131 is not provided. A notch 431 is provided at an end of the cover plate 430 away from the second card exit 420 of the second cavity 410. The notch 431 is configured to expose the cards 700 in the second cavity 410. When needing to push the cards 700 out of the second card exit 420, the user may easily touch the cards 700 with a finger through the notch 431, and push the cards 700 out of the second card exit 420. As such, the cards can be more conveniently taken out from the second cavity 410.

Referring to FIG. 5, in an embodiment of the present disclosure, the case 100 includes a first side wall 130, a second side wall 140, and a frame 150 connected between the first side wall 130 and the second side wall 140. It can be understood that the second side wall 140 and the frame 150 are integrally formed, and the first side wall 130 is fixedly connected to the frame 150 by a screw. Alternatively, the first side wall 130 and the frame 150 are integrally formed, and the second side wall 140 is fixedly connected to the frame 150 by a screw; or the first side wall 130 and the second side wall 140 are fixedly connected to the frame 150 by screws.

Figure 8:
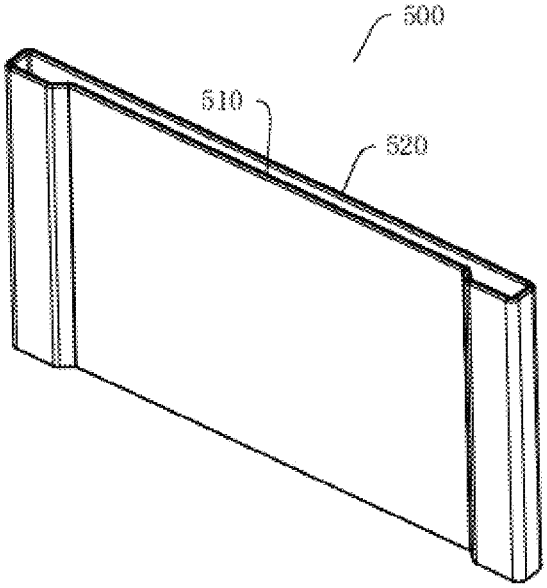
FIG. 8 is a schematic structural diagram of an elastic band in a card holder according to an embodiment of the present disclosure.

Referring to FIG. 5 and FIG. 8, FIG. 8 is a schematic structural diagram of an elastic band 500 in the card holder shown in FIG. 5. The cover member 400 is a cover plate 430, and the cover plate 430 is connected to the first side wall 130 by an elastic band 500. It can be understood that the elastic band 500 includes a first band body 510 and a second band body 520. The first band body 510 is attached to the cover plate 430. For example, the first band body 510 is fixed to the cover plate 430 by adhesion, threading (fixing by threading on the outer and inner sides of the cover plate 430), buckling, threaded connection, or other means. The second band body 520 is attached to an inner side of the first side wall 130. For example, the second band body 520 is connected to the inner side of the first side wall 130 by adhesion, threading (fixing by threading on the outer and inner sides of the first side wall 130), buckling, threaded connection, or other means. The first band body 510 and the second band body 520 are two parts of the elastic band 500. The first band body 510 and the second band body 520 may be directly connected to form the elastic band 500, i.e., the length of the elastic band 500 is increased by elastic deformation of the first band body 510, the second band body 520, and the connection between the first band body 510 and the second band body 520. Alternatively, the first band body 510 and the second band body 520 may be connected by a connecting band to form the elastic band 500, i.e., the length of the elastic band 500 is increased mainly by elastic deformation of the connecting band. The elastic band 500 is configured to enable the cover plate 430 to flexibly move relative to the first side wall 130 to form the second cavity 410 having a variable volume. The cover plate 430 elastically moves toward or away from the first side wall 130 depending on the number of cards 700 in the second cavity 410, thereby maintaining a minimum size of the card holder.

Alternatively, the elastic band 500 further includes a third band body in addition to the first band body 510 and the second band body 520. An end of the third band body is connected to the first band body 510 attached to the cover plate 430, for example, to a part of the first band body 510 on the inner side of the cover plate 430. The other end of the third band body is connected to the closed end 1312 of the first side wall 130, for example, fixedly connected to the inner side of the first side wall 130. A plurality of third band bodies may be provided at intervals according to a width requirement of the cover plate 430. The configuration of the third band body can improve the reliability of connection between the cover plate 430 and the first side wall 130, and can constrain the cards 700 in the second cavity 410 between the third band body and the first side wall 130, to prevent the cards 700 from falling out of the card holder from the closed end 1312.

Figure 9:
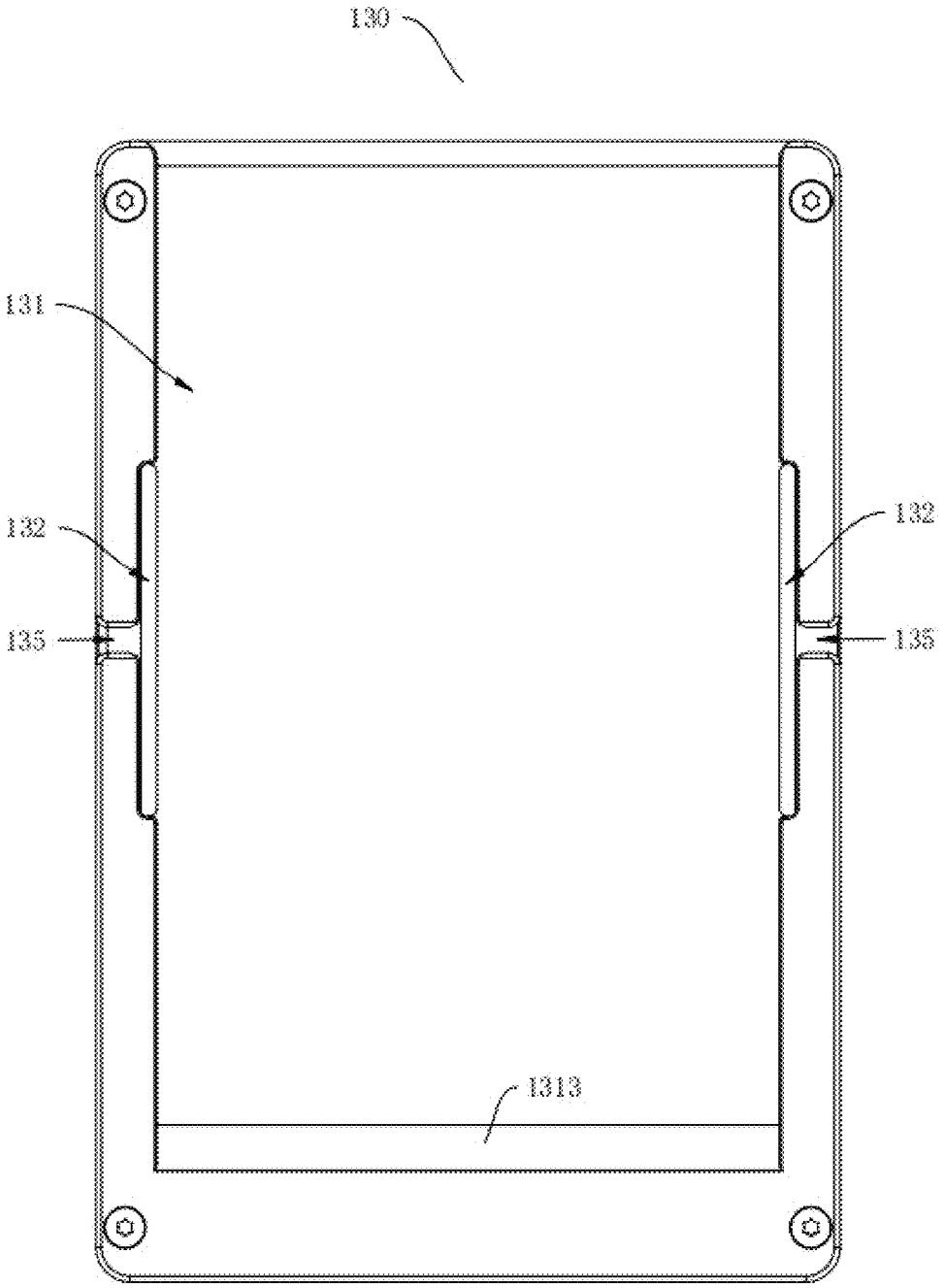
FIG. 9 is a schematic structural diagram of a first side wall in a card holder according to an embodiment of the present disclosure from another viewing angle.
Figure 10:
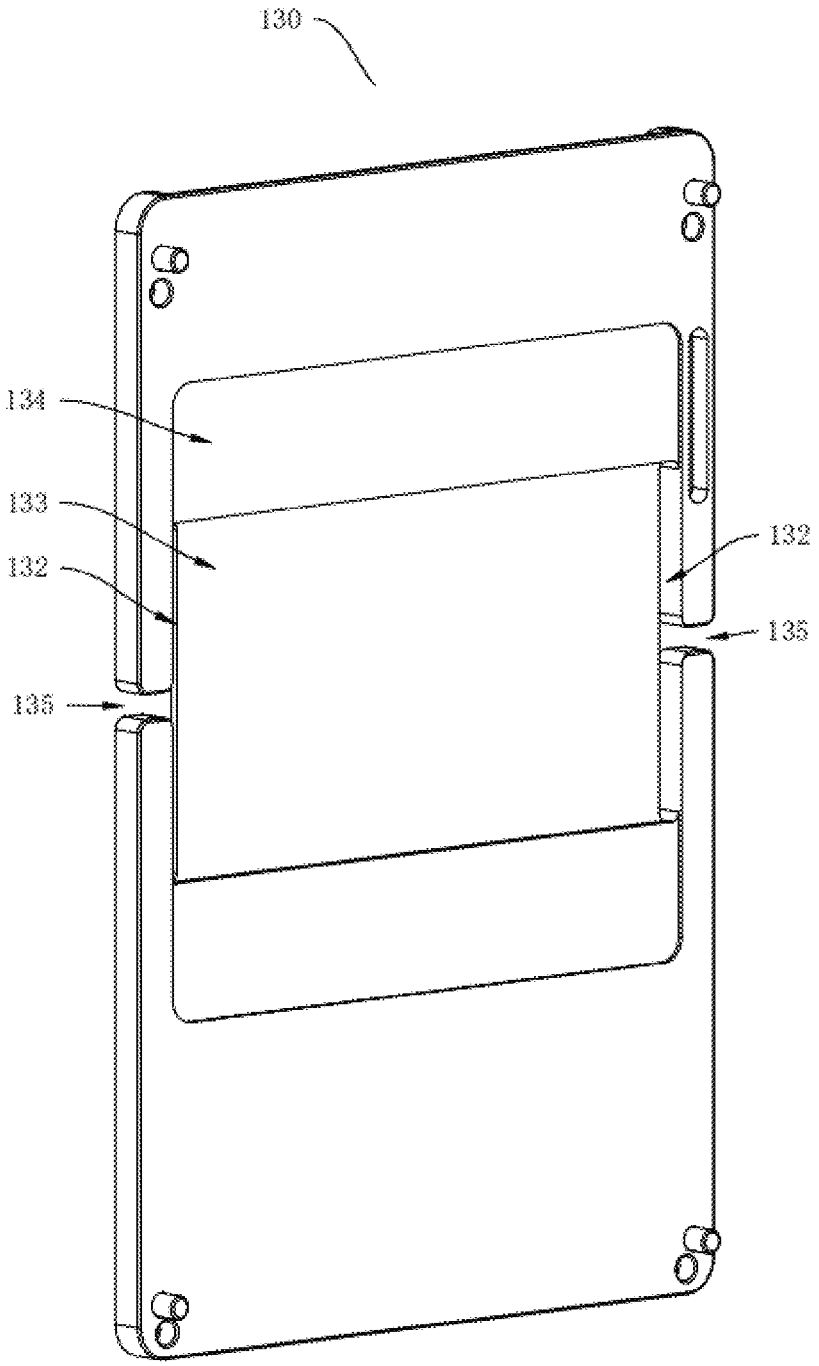
FIG. 10 is a schematic structural diagram of a first side wall in a card holder according to an embodiment of the present disclosure from still another viewing angle.

Referring to FIG. 6, FIG. 9, and FIG. 10, FIG. 9 and FIG. 10 are schematic structural diagrams of the first side wall 130 from two other viewing angles. A through hole 132 is provided in each of two sides of the first side wall 130. The through holes 132 run through the inner side and the outer side of the first side wall 130.

Figure 11:
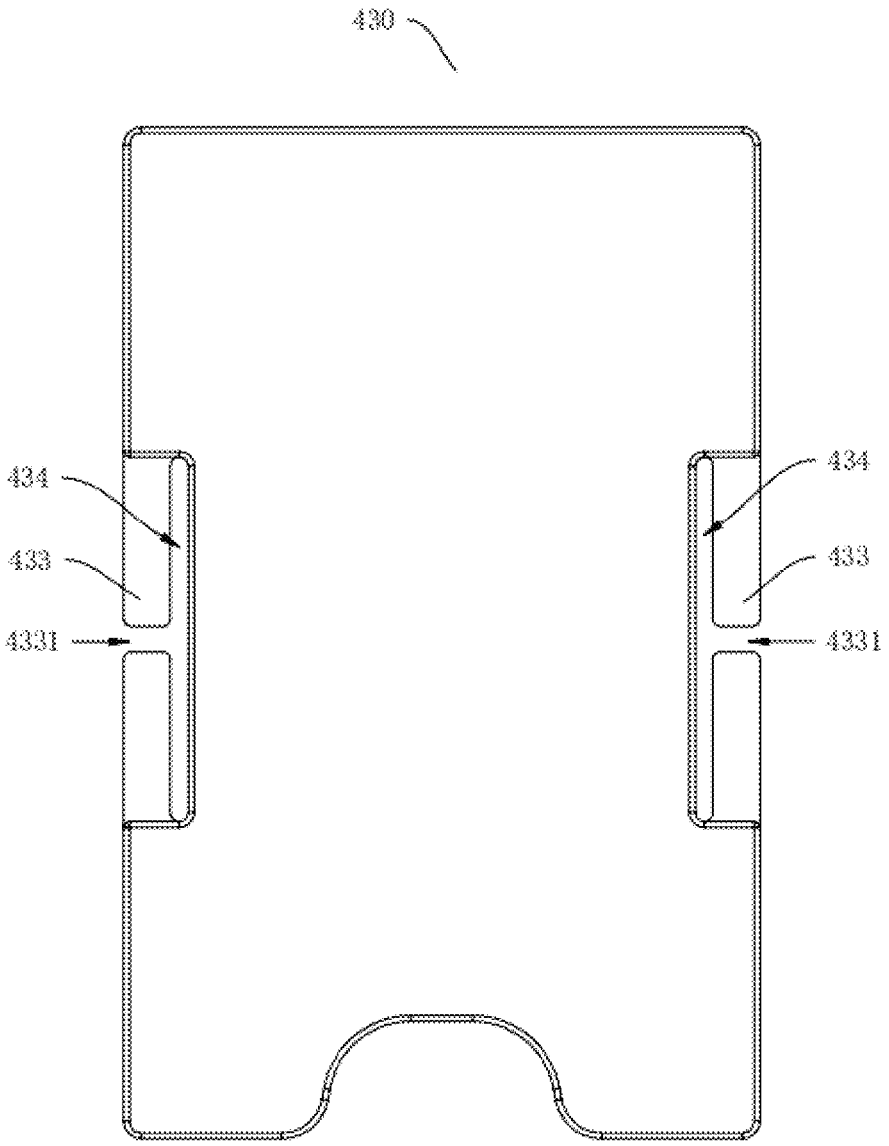
FIG. 11 is a schematic structural diagram of a cover plate in a card holder according to an embodiment of the present disclosure from another viewing angle.
Figure 12:
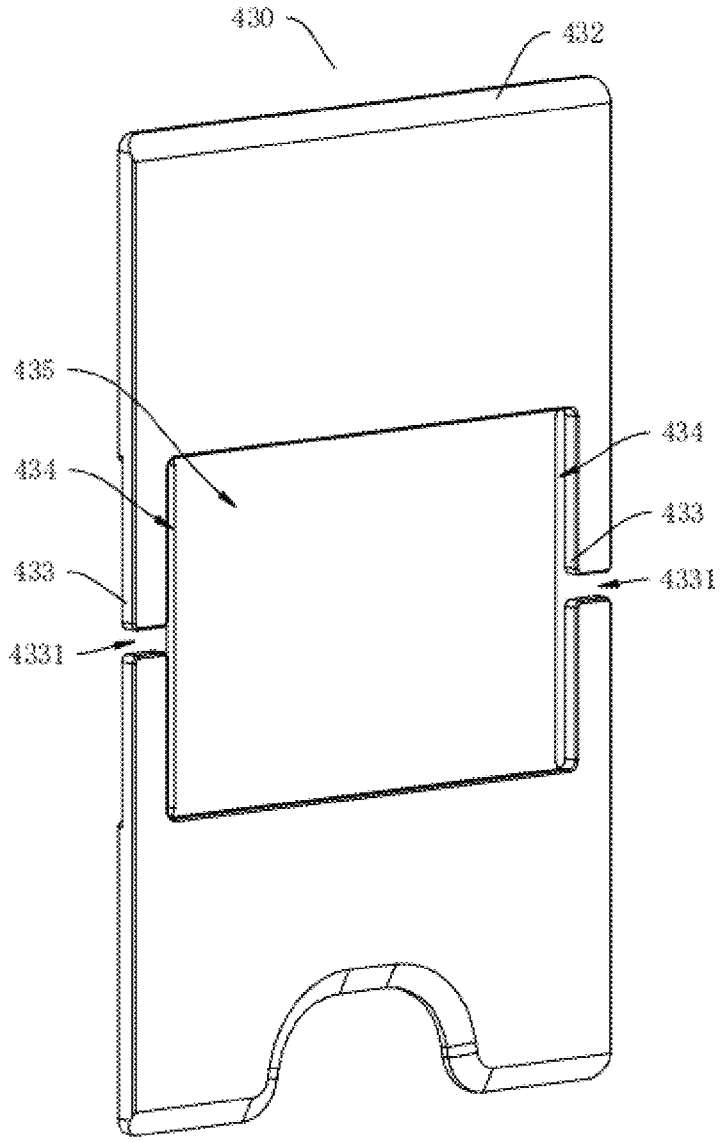
FIG. 12 is a schematic structural diagram of a cover plate in a card holder according to an embodiment of the present disclosure from still another viewing angle.

Referring to FIG. 7, FIG. 11, and FIG. 12, FIG. 11 and FIG. 12 are schematic structural diagrams of the cover plate 430 from two other viewing angles. A positioning piece 433 is arranged on each of two sides of the cover plate 430. Perforations 434 are formed between the two positioning pieces 433 and the cover plate 430, respectively. The perforations 434 run through the inner side and outer side of the cover plate 430.

Figure 13:
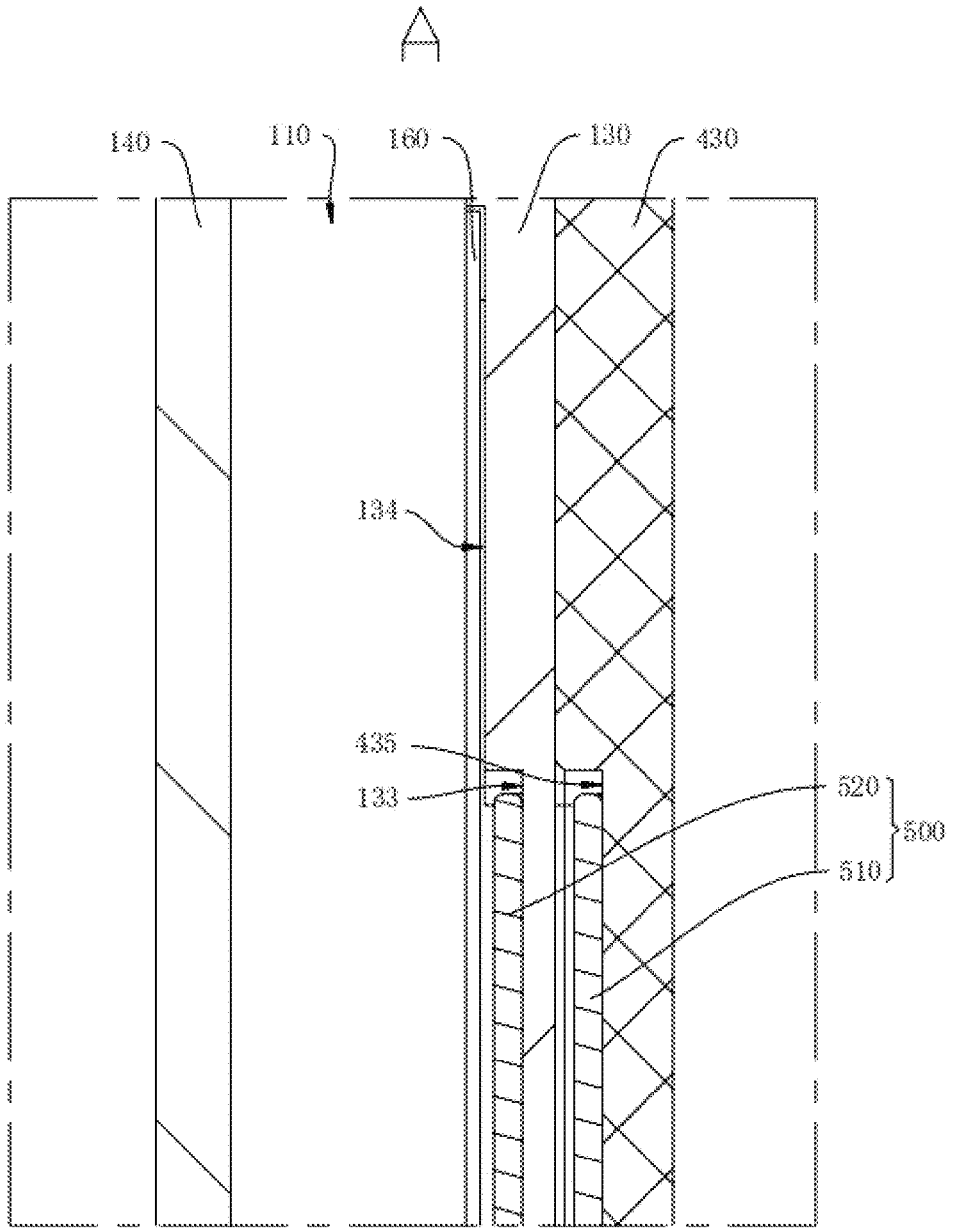
FIG. 13 is an enlarged view of part A in FIG. 4.

Still referring to FIG. 5 and FIG. 8, as well as FIG. 13, FIG. 13 is an enlarged cross-sectional view of a part of the structure of the card holder of this embodiment. A head and a tail of the elastic band 500 are connected to form an annular shape. A part of the elastic band 500 adjacent to the cover plate 430 is passed through the inner side and the outer side of the cover plate 430 through the two perforations 434, and a part of the elastic band 500 adjacent to the first side wall 130 is wound around the inner side of the first side wall 130 through the two through holes 132. The elastic band 500 of this embodiment surrounds and connects the cover plate 430 and the first side wall 130, such that a stable flexible movement structure is formed between the cover plate 430 and the first side wall 130, to improve the stability of the cards 700. Moreover, the elastic band 500 is easy to mount.

Referring to FIG. 6 and FIG. 9, a groove 131 is provided on the outer side of the first side wall 130. The groove 131 is configured to position the cover plate 430 when there is no card 700 in the second cavity 410, and position the cards 700 when there are cards 700 in the second cavity 410. The two through holes 132 are respectively located in two sides of the groove 131, and do not interfere with the positioning of the cover plate 430 or the cards 700 in the groove 131.

Referring to FIG. 7 and FIG. 12, the two positioning pieces 433 are respectively recessed relative to the outer side of the cover plate 430, and a first communication groove 435 between the two positioning pieces 433 is provided on the inner side of the cover plate 430. Two ends of the first communication groove 435 are in communication with an outer side of the positioning pieces 433 through the perforations 434. The first band body 510 of the elastic band 500 is passed through an outer side of the two positioning pieces 433. Because the positioning pieces 433 are recessed relative to the outer side of the cover plate 430, the elastic band 500 does not protrude from the outer side of the cover plate 430, which is beneficial to reducing the size of the card holder. In this embodiment, the part of the elastic band 500 wound around the outer side of the positioning pieces 433 is flush with the outer side of the cover plate 430. Because the first band body 510 is positioned in the first communication groove 435 through the perforations 434, the elastic band 500 does not protrude from the inner side of the cover plate 430. As such, the interference of the elastic band 500 with the cards 700 can be suppressed during inserting the cards 700 into the second cavity 410 and pushing out the cards 700. Therefore, the cards can be more smoothly inserted into and taken out of the second cavity 410.

Referring to FIG. 9 and FIG. 10, a second communication groove 133 between the two through holes 132 is provided on the inner side of the first side wall 130, and the second band body 520 of the elastic band 500 is positioned in the second communication groove 133 and is passed out of the outer side of the first side wall 130 through the through holes 132. Because the second band body 520 is positioned in the second communication groove 133, the elastic band 500 does not protrude from the inner side of the first side wall 130. As such, the interference of the elastic band 500 with the cards 700 can be suppressed during inserting the cards 700 into the first cavity 110 and pushing out the cards 700, i.e., the elastic band 500 does not interfere with the operation of inserting the cards into the first cavity 110 and the operation of taking the cards out of the first cavity 110. Therefore, the cards can be more smoothly inserted into and taken out of the first cavity 110.

Referring to FIG. 10 and FIG. 13, the case 100 further includes a sealing plate 160. The sealing plate 160 is fixedly connected to the inner side of the first side wall 130. The sealing plate 160 covers the second communication groove 133 to confine the elastic band 500 in the second communication groove 133, to prevent the elastic band 500 from jumping during retraction to interfere with the cards 700 in the first cavity 110, and ensure that the cards 700 can be smoothly taken out of the first cavity 110. The sealing plate 160 is configured to be flush with the inner side of the first side wall 130, such that the card stack in the first cavity 110 can be smoothly pushed out of the first card exit 120 without being stuck.

Referring to FIG. 10 and FIG. 13, a mounting groove 134 is provided on the inner side of the first side wall 130. The mounting groove 134 is located at an opening of the second communication groove 133, and can cover the second communication groove 133. The sealing plate 160 is fixedly connected to the mounting groove 134, to ensure that a side of the sealing plate 160 facing the first cavity 110 is flush with the inner side of the first side wall 130, or slightly recessed relative to the inner side of the first side wall 130, or slightly raised relative to the inner side of the first side wall 130.

Referring to FIG. 6, FIG. 7, FIG. 9, FIG. 10, FIG. 11, and FIG. 12, a first breakage feature 4331 extending in a left-right direction is provided in a middle part of each of the positioning pieces 433 in this embodiment, to facilitate the assembly of the elastic band 500, the first side wall 130, and the cover plate 430, and improve the assembly efficiency of the card holder. The first breakage feature 4331 is configured to enable the elastic band 500 to pass through the corresponding perforation 434 from the outer side of the positioning piece 433, to realize the fixed connection between the first band body 510 and the positioning piece 433. A second breakage feature 135 extending in the left-right direction is provided in a middle part of the first side wall 130. The second breakage feature 135 is configured to enable the elastic band 500 to pass through the corresponding through hole 132 from the outer side of the first side wall 130, to realize the connection between the second band body 520 and the first side wall 130.

In the card holder of this embodiment, an outer side of the second side wall 140 of the case 100 is configured as a flat surface, to further improve the storage function of the card holder. The second side wall 140 is configured for mounting an expansion module, such as a module having a pocket, for accommodating cards 700, coins, banknotes, or a tracking device (e.g., airtag), etc. For example, the expansion module is a wallet or the like. The expansion module may be connected to the outer side of the second side wall 140 by glue bonding, magnetic attraction, or other means, to expand the functions of the card holder.

Figure 15:
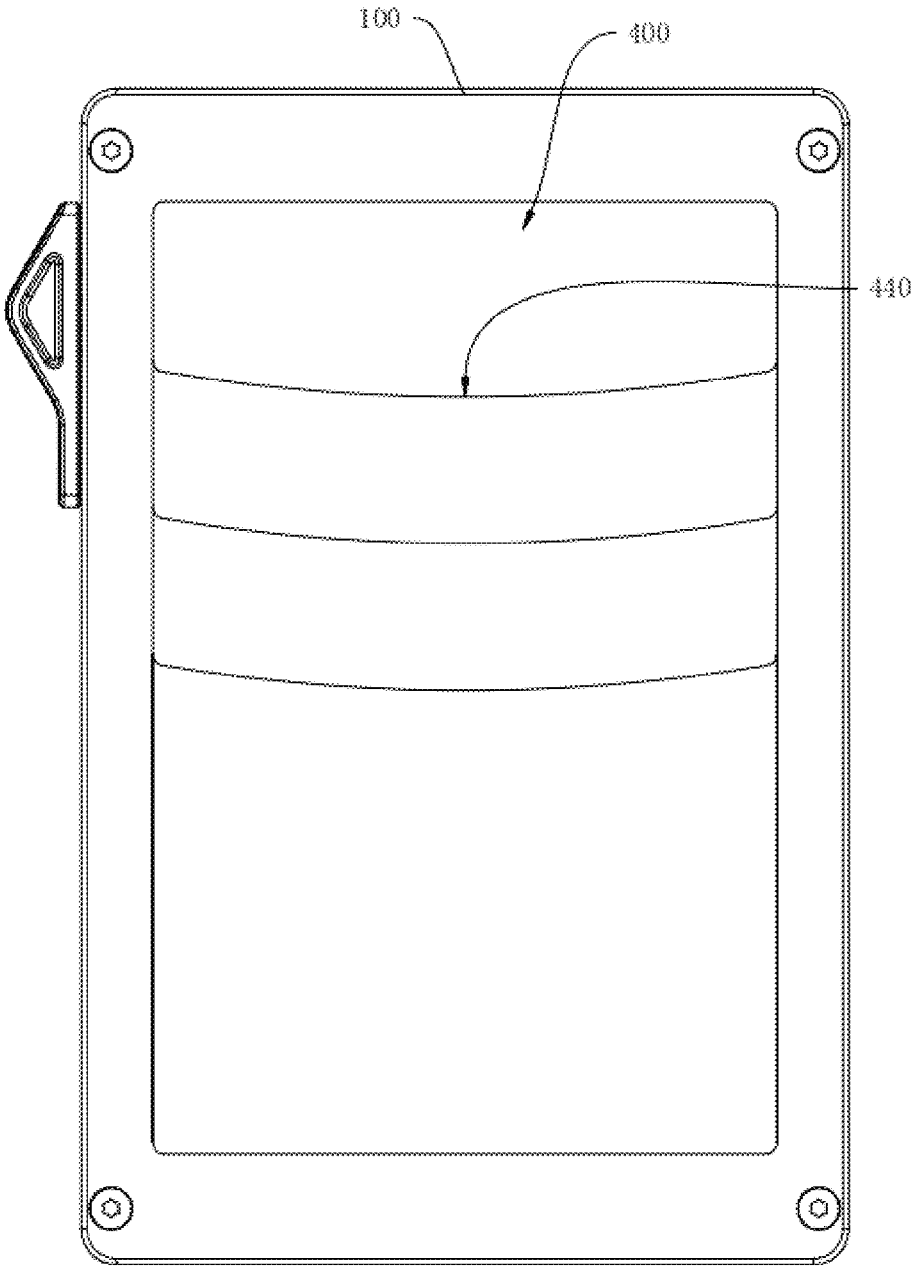
FIG. 15 is a schematic structural diagram of a card holder according to another embodiment of the present disclosure.
Figure 16:
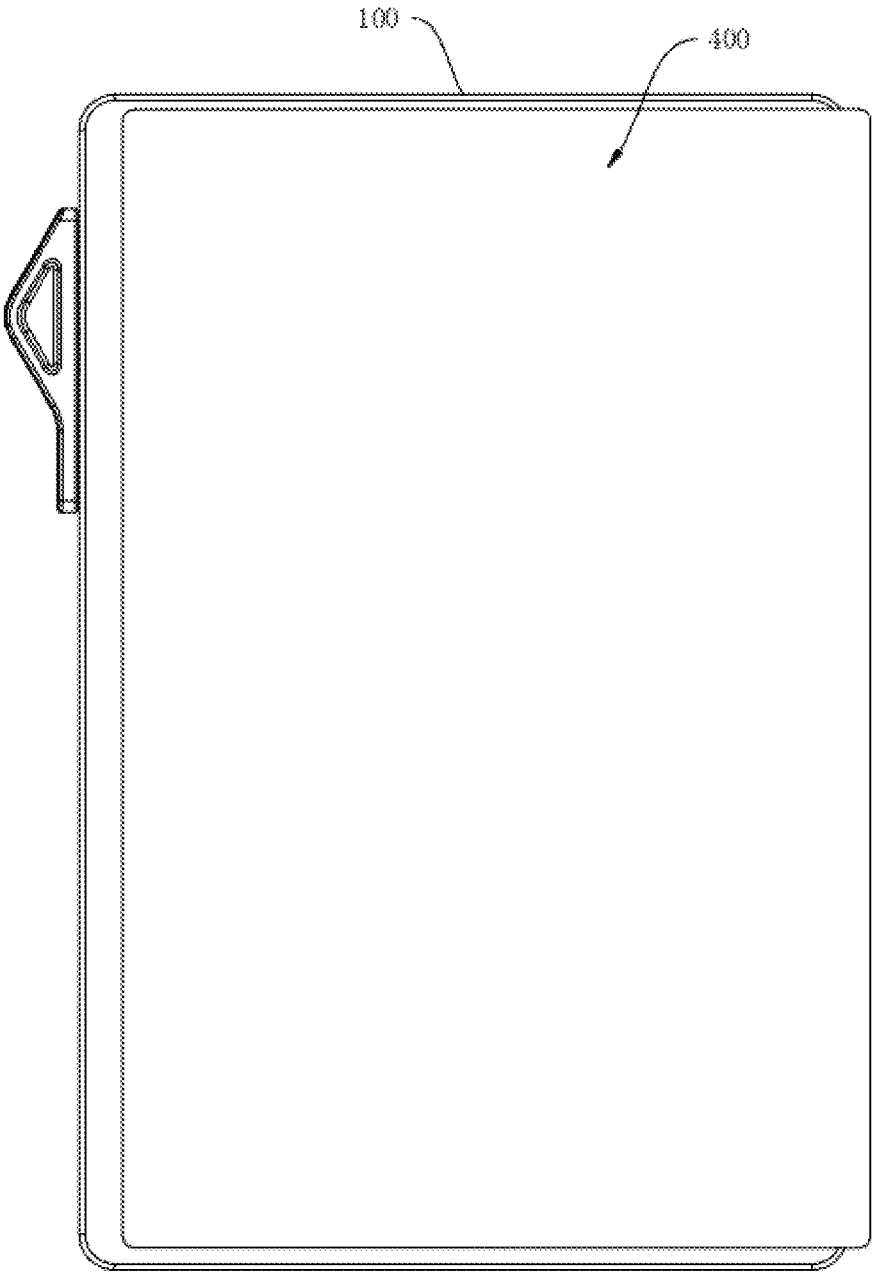
FIG. 16 is a schematic structural diagram of a card holder according to another embodiment of the present disclosure.

Referring to FIG. 15 and FIG. 16, FIG. 15 and FIG. 16 are respectively schematic structural diagrams of card holders according to two other embodiments of the present disclosure. In this embodiment, the cover member 400 is a structure including the second cavity 410 and made of a soft material such as leather, lycra, or elastic cloth. Because the soft material is elastic, the second cavity 410 has a variable volume. The cover member 400 in this embodiment is fixedly connected to the first side wall 130 of the case 100, and has one or more pockets 440 for accommodating cards 700. The interior of the pocket 440 constitutes a wall surface of the second cavity 410, and an opening of the pocket 440 constitutes the second card exit 420. The part of the cover member 400 fixedly connected to the first side wall 130 and the first side wall 130 together form a part of the wall surface of the second cavity 410, and the other part of the cover member 400 forms the other part of the wall surface of the second cavity 410. For example, the cover member 400 in this embodiment may be fixed to the case 100 by a screw, bundled to the case 100, or adhered to the case 100 by glue.

Figure 17:
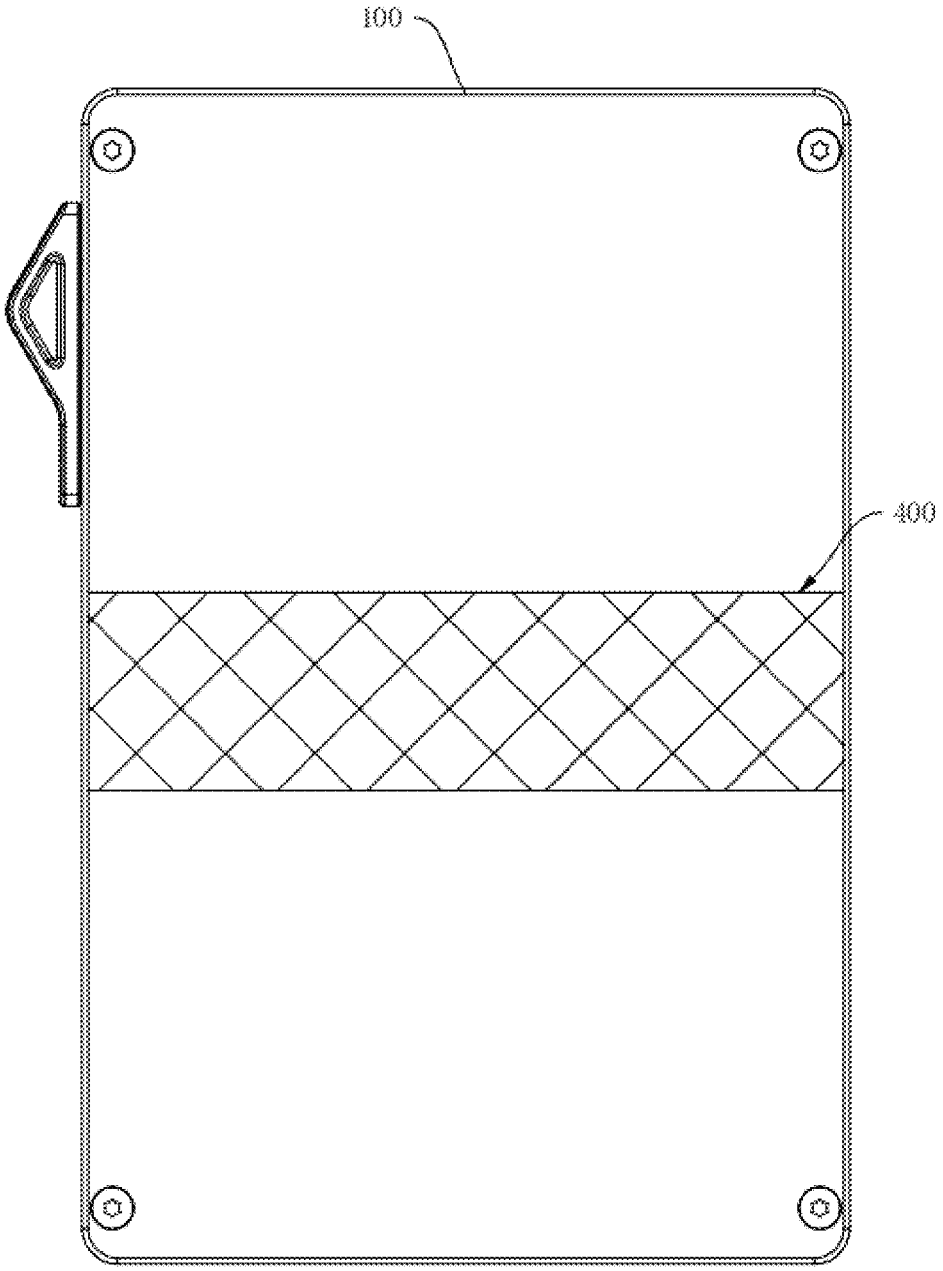
FIG. 17 is a schematic structural diagram of a card holder according to another embodiment of the present disclosure.

Referring to FIG. 17, FIG. 17 is a schematic structural diagram of a card holder according to another embodiment of the present disclosure. In this embodiment, the cover member 400 may also be a band which is elastic and surrounds the outer side of the first side wall 130. A second cavity 410 having a variable volume is defined by the band. Different numbers of cards 700 are tightly attached to the case 100 by the band. The band may extend from the inner side to the outer side of the first side wall 130, or may be directly fixed to the outer side of the first side wall 130. In addition, a metal baffle, a cloth strip, or the like may be fixedly connected to a part of the band away from the first side wall 130, to improve the constraint effect of the cover member 400 on the cards 700.

Figure 18:
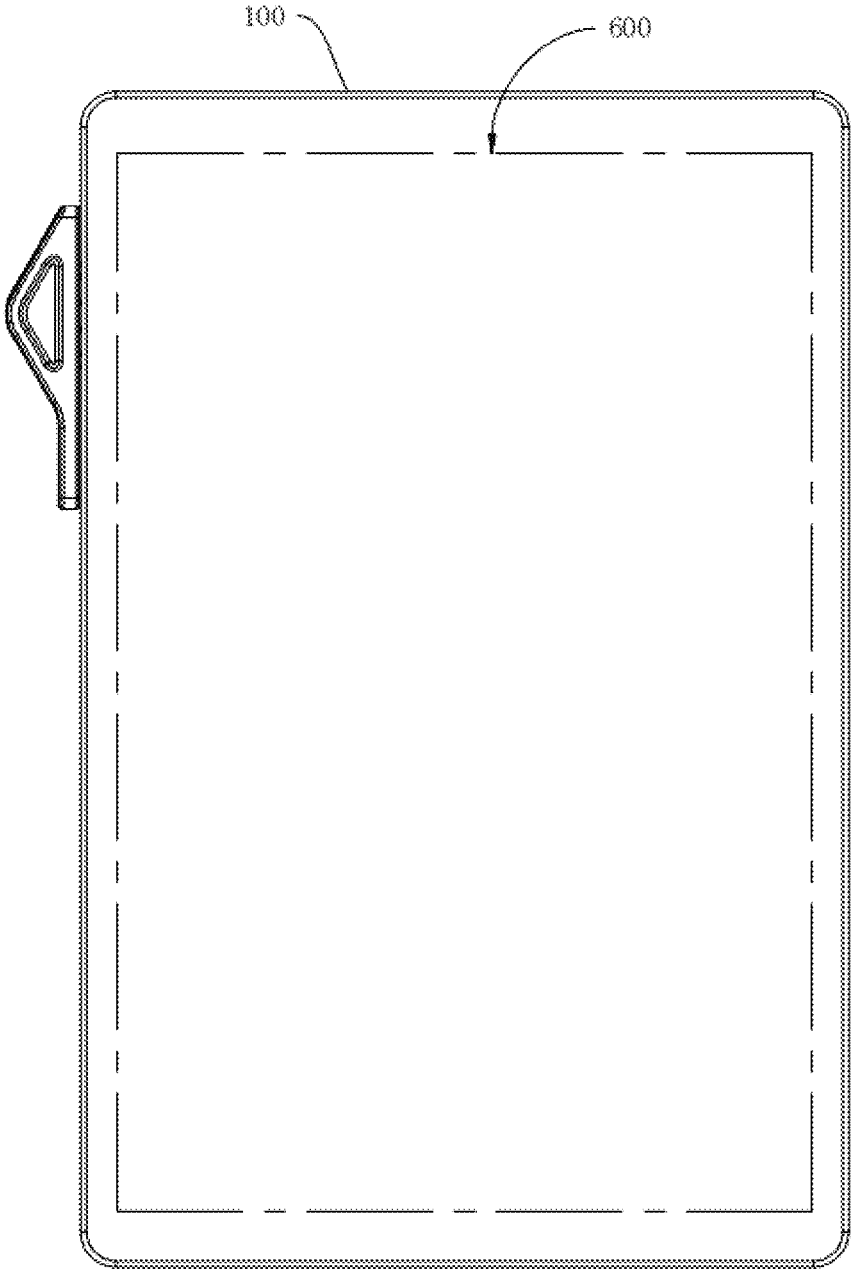
FIG. 18 is a schematic structural diagram of a card holder according to another embodiment of the present disclosure.

Referring to FIG. 18, FIG. 18 is a schematic structural diagram of a card holder according to still another embodiment of the present disclosure. In this embodiment, the card holder includes a case 100 and a card arm 200. The case 100 includes a first cavity 110 configured to accommodate a card stack including at least two cards 700. A first card exit 120 is provided on a side wall of the case 100. The first card exit 120 is in communication with the first cavity 110. The card arm 200 is arranged in the first cavity 110, and is configured to push the card stack out of the first card exit 120, such that at least some of the cards 700 in the card stack are stacked in a dispersed state outside the first cavity 110. The case 100 has a volume expansion feature 600. The volume expansion feature 600 is arranged on an outer side of a side wall of the case 100 parallel to the card surface of the cards 700. The volume expansion feature 600 includes a second cavity 410 configured to accommodate at least one card 700. The second cavity 410 is provided with a second card exit 420. The second cavity 410 is configured in such a manner that the volume of the second cavity 410 can vary with the number of cards 700. For example, the volume expansion feature may be a leather sleeve, a lycra sleeve, a wallet, or a band which is elastic and surrounds the case 100, etc., or may be a structure that cooperates with the case 100 to define the second cavity 410, e.g., a combination of the elastic band 500 and the cover plate 430, which is not particularly limited herein.

In the embodiments of the present disclosure, with the configuration of the structure integrating the case 100 and the card arm 200, the first cavity 110 of the case 100 is used for accommodating the cards 700, and the card arm 200 can push the card stack out of the first card exit 120, such that the cards are stacked in the dispersed state, making it convenient for the user to take out the cards 700. With the additional configuration of the volume expansion feature 600 on the outer side of the case 100, the volume expansion feature 600 includes the second cavity 410 and the second card exit 420 through which the cards 700 can be pushed out of the second cavity 410. The second cavity 410 is used for accommodating the cards 700 and its volume can vary with the number of cards 700 received therein. Therefore, the volume expansion feature 600 can accommodate more cards 700 on the basis of the first cavity 110 of the case 100 without significantly increasing the size of the card holder. With the configuration of the first cavity 110 and the second cavity 410 for accommodating the cards 700 in the card holder of this embodiment, the number of cards 700 that can be received in the card holder can be increased without significantly increasing the size of the card holder.

It can be understood that the volume expansion feature 600 may be bonded to the outer side of the case 100 by glue, fixedly connected to the case 100 by a screw, or fixedly connected to the case 100 by bundling. Alternatively, the volume expansion feature 600 may form a combined structure with a side wall of the case 100, and the combined structure is fixedly connected to another component of the case 100, e.g., the frame 150 of the case 100, by a screw.

The embodiments of the present disclosure have been described in detail above with reference to the accompanying drawings, but the present disclosure is not limited to the above embodiments, and various changes may be made within the knowledge of those having ordinary skills in the art without departing from the protection scope of the present disclosure.

What is claimed is:

1. A card holder, comprising:

a case, comprising a first cavity configured to accommodate a card stack comprising at least two cards, wherein a first card exit is provided on an end wall of the case, and the first card exit is in communication with the first cavity;

a card arm, arranged in the first cavity, and configured to push the card stack out of the first card exit, such that at least some of the cards in the card stack are stacked in a dispersed state outside the first cavity; and a cover member, arranged on an outer side of a side wall of the case, and configured in such a manner that a second cavity configured to receive at least one card and having a variable volume is defined by the cover member and the side wall, wherein the second cavity is provided with a second card exits;

wherein the cover member comprises a cover plate, and the cover plate is made of metal.

2. The card holder of claim 1, wherein the cover plate is connected to the side wall of the case by an elastic band, and the elastic band is configured to apply an elastic force toward the side wall to the cover plate.

3. The card holder of claim 2, wherein a groove which is inwardly recessed is provided on the outer side of the side wall, and the groove is configured to accommodate the cover plate.

4. The card holder of claim 3, wherein an end of the groove adjacent to the first card exit is an open end, and the second card exit of the second cavity is defined between the open end of the groove and the cover plate; and an end of the groove away from the first card exit is closed.

5. The card holder of claim 4, wherein an inclined surface is provided at the closed end of the groove, and the inclined surface is configured to guide a finger of a user to move from the side wall toward a bottom wall of the groove, to push the at least one card in the second cavity out of the second card exit.

6. The card holder of claim 5, wherein a notch is provided at an end of the cover plate adjacent to the inclined surface, the notch is configured to expose the at least one card in the second cavity, and sliding of a finger of a user from the inclined surface toward the notch is capable of causing the at least one card to be pushed out of the second card exit.

7. The card holder of claim 4, wherein a first guide surface is provided at an end of a bottom wall of the groove adjacent to the second card exit, a second guide surface is provided at an end of an inner side of the cover plate adjacent to the second card exit, and the second guide surface and the first guide surface are configured to be inclined toward the second cavity in a direction in which the at least one card enters the second cavity.

8. The card holder of claim 1, wherein a notch is provided at an end of the cover plate away from the second card exit of the second cavity, the notch is configured to expose the at least one card in the second cavity, and the notch is configured in such a manner that movement of a finger of a user into the notch is capable of causing the at least one card to be pushed out of the second card exit.

9. The card holder of claim 1, wherein the case comprises a first side wall, a second side wall, and a frame connected between the first side wall and the second side wall, the cover plate is connected to the first side wall by an elastic band, the elastic band comprises a first band body and a second band body, the first band body is attached to the cover plate, the second band body is attached to an inner side of the first side wall, and the elastic band is configured to enable the cover plate to flexibly move relative to the first side wall to form the second cavity.

10. The card holder of claim 9, wherein a through hole running through the inner side and an outer side of the first side wall is provided in each of two sides of the first side wall; a positioning piece is arranged on each of two sides of the cover plate, and perforations are formed between the two positioning pieces and the cover plate, respectively; a head and a tail of the elastic band are connected to form an annular shape, and the elastic band is passed through an inner side and an outer side of the cover plate through the two perforations, and is wound around the inner side of the first side wall through the two through holes.

11. The card holder of claim 10, wherein a groove is provided on the outer side of the first side wall, and the two through holes are respectively located in two sides of the groove; the two positioning pieces are respectively recessed relative to the outer side of the cover plate, a first side wall communication groove between the two positioning pieces is provided on the inner side of the cover plate, and two ends of the first side wall communication groove are in communication with an outer side of the positioning pieces through the perforations; and the elastic band is passed through the outer side of the positioning pieces and is positioned in the first side wall communication groove through the perforations.

12. The card holder of claim 10, wherein a cover plate communication groove between the two through holes is provided on the inner side of the first side wall, and the elastic band is positioned in the cover plate communication groove and is passed out of the outer side of the first side wall through the through holes.

13. The card holder of claim 12, wherein the case further comprises a sealing plate, the sealing plate is fixedly connected to the inner side of the first side wall and covers the cover plate communication groove, and the sealing plate is configured to be flush with the inner side of the first side wall.

14. A card holder, comprising:

a case, comprising a first cavity configured to accommodate a card stack comprising at least two cards, wherein a first card exit is provided on a side wall of the case, and the first card exit is in communication with the first cavity; and a card arm, arranged in the first cavity, and configured to push the card stack out of the first card exit, such that at least some of the cards in the card stack are stacked in a dispersed state outside the first cavity;

wherein the case comprises a volume expansion feature arranged on an outer side of the case, the volume expansion feature comprises a second cavity configured to accommodate at least one card, the second cavity is provided with a second card exit, and the second cavity is configured in such a manner that a volume of the second cavity varies with a number of the at least one card; and wherein the volume expansion feature is a sleeve and is adhered to the outer side of the case by glue or fixedly connected to the outer side of the case by a screw.

15. A card holder, comprising:

a case, comprising a first cavity configured to accommodate a card stack comprising at least two cards, wherein a first card exit is provided on a side wall of the case, and the first card exit is in communication with the first cavity; and a card arm, arranged in the first cavity, and configured to push the card stack out of the first card exit, such that at least some of the cards in the card stack are stacked in a dispersed state outside the first cavity;

wherein the case comprises a volume expansion feature arranged on an outer side of the case, the volume expansion feature comprises a second cavity configured to accommodate at least one card, the second cavity is provided with a second card exit, and the second cavity is configured in such a manner that a volume of the second cavity varies with a number of the at least one card; and wherein the volume expansion feature forms a combined structure with a side wall of the case, and the combined structure is fixedly connected to a frame of the case by a screw.

16. A card holder, comprising:

a case, comprising a first cavity configured to accommodate a card stack comprising at least two cards, wherein a first card exit is provided on an end wall of the case, and the first card exit is in communication with the first cavity;

a card arm, arranged in the first cavity, and configured to push the card stack out of the first card exit, such that at least some of the cards in the card stack are stacked in a dispersed state outside the first cavity; and a cover member, arranged on an outer side of a side wall of the case, and configured in such a manner that a second cavity configured to receive at least one card and having a variable volume is defined by the cover member and the side wall, wherein the second cavity is provided with a second card exit;

wherein the cover member is made of leather, lycra, or elastic cloth, and the cover member is fixedly connected to the side wall of the case and has a pocket.

* * * * *